US010954088B2

(12) United States Patent
Sakurai et al.

(10) Patent No.: US 10,954,088 B2
(45) Date of Patent: Mar. 23, 2021

(54) SHEET CONVEYING APPARATUS AND IMAGE FORMING APPARATUS

(71) Applicant: CANON KABUSHIKI KAISHA, Tokyo (JP)

(72) Inventors: Takanori Sakurai, Toride (JP); Hiroshi Kokubo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/954,817

(22) Filed: Apr. 17, 2018

(65) Prior Publication Data

US 2018/0305152 A1 Oct. 25, 2018

(30) Foreign Application Priority Data

Apr. 24, 2017 (JP) ..... JP2017-085130

(51) Int. Cl.

| | |
|---|---|
| ***B65H 85/00*** | (2006.01) |
| ***B65H 5/26*** | (2006.01) |
| ***B65H 5/06*** | (2006.01) |
| ***B65H 5/36*** | (2006.01) |
| ***B65H 5/38*** | (2006.01) |

(52) U.S. Cl.

CPC ..... *B65H 5/26* (2013.01); *B65H 5/062* (2013.01); *B65H 5/36* (2013.01); *B65H 5/38* (2013.01); *B65H 85/00* (2013.01); *B65H 2301/3331* (2013.01); *B65H 2801/06* (2013.01)

(58) Field of Classification Search

CPC ..... B65H 85/00; B65H 5/062; B65H 5/38; B65H 5/36

USPC ..... 271/65, 186, 225, 224, 184, 185

See application file for complete search history.

(56) References Cited

U.S. PATENT DOCUMENTS 3,100,113 A * 8/1963 Bennett ..... G06K 13/04 271/184
4,262,895 A * 4/1981 Wenthe, Jr. ..... B65H 15/00 271/184

(Continued)

FOREIGN PATENT DOCUMENTS

CN 103863857 A 6/2014
CN 105388723 A 3/2016

(Continued)

OTHER PUBLICATIONS

Jan. 5, 2021 Japanese Official Action in Japanese Patent Appln. No. 2017-085130.

(Continued)

*Primary Examiner* — Thomas A Morrison
(74) *Attorney, Agent, or Firm* — Venable LLP

(57) ABSTRACT

Disclosed is a sheet conveying apparatus, including: a conveying member conveying a sheet; and a first and second changing portions s configured to change a conveying direction of the sheet conveyed by the conveying member by curving the sheet, wherein the conveying direction of the sheet being conveyed by the conveying member is changed by the first changing portion so that the sheet is conveyed toward the second changing portion. The relationship θa>θb is satisfied where θa indicates an angle in which a conveying direction of the sheet is changed by the first changing portion and θb indicates an angle in which a conveying direction of the sheet is changed by the second changing portion.

18 Claims, 11 Drawing Sheets

(56) References Cited

U.S. PATENT DOCUMENTS

| | | | | |
|---|---|---|---|---|
| 5,317,377 | A * | 5/1994 | Rubscha | B65H 15/00 271/186 |
| 6,550,762 | B2 * | 4/2003 | Stoll | B65H 15/00 271/186 |
| 6,612,566 | B2 * | 9/2003 | Stoll | B65H 15/00 271/186 |
| 6,626,428 | B2 * | 9/2003 | Soga | B65H 29/14 271/182 |
| 7,318,585 | B2 * | 1/2008 | Soshiroda | B41J 13/009 271/176 |
| 8,991,824 | B2 | 3/2015 | Suzuki | |
| 9,442,448 | B2 | 9/2016 | Kodama et al. | |
| 9,592,992 | B2 | 3/2017 | Mizuguchi et al. | |
| 9,855,770 | B2 | 1/2018 | Kodama et al. | |
| 9,896,291 | B2 | 2/2018 | Sugiyama | |
| 10,391,791 | B2 | 8/2019 | Kodama et al. | |
| 2002/0066995 | A1 * | 6/2002 | Stoll | B65H 15/00 271/186 |
| 2003/0102624 | A1 * | 6/2003 | Stoll | B65H 15/00 271/186 |
| 2003/0122299 | A1 | 7/2003 | Soga et al. | |
| 2010/0239296 | A1 * | 9/2010 | Kimura | G03G 15/234 399/68 |
| 2012/0082490 | A1 | 4/2012 | Shin et al. | |
| 2014/0159303 | A1 | 6/2014 | Suzuki | |
| 2015/0309462 | A1 * | 10/2015 | Sunohara | G03G 15/6529 271/264 |
| 2016/0060058 | A1 | 3/2016 | Sugiyama | |
| 2016/0090258 | A1 * | 3/2016 | Sano | B65H 85/00 271/225 |
| 2016/0116881 | A1 | 4/2016 | Kodama et al. | |
| 2016/0347090 | A1 | 12/2016 | Kodama et al. | |
| 2017/0267473 | A1 * | 9/2017 | Watanabe | B65H 5/36 |
| 2018/0079229 | A1 | 3/2018 | Kodama et al. | |
| 2019/0329572 | A1 | 10/2019 | Kodama et al. | |

FOREIGN PATENT DOCUMENTS

| | | | |
|---|---|---|---|
| JP | H05-286626 | A | 11/1993 |
| JP | 2010-036995 | A | 2/2010 |
| JP | 2012-078836 | A | 4/2012 |
| JP | 2015-025911 | A | 2/2015 |
| JP | 2016-084236 | A | 5/2016 |
| JP | 2016-160030 | A | 5/2016 |

OTHER PUBLICATIONS

Dec. 11, 2020 Chinese Official Action in Chinese Patent Appln. No. 201810364090.0.

* cited by examiner

SHEET CONVEYING APPARATUS AND IMAGE FORMING APPARATUS

BACKGROUND OF THE INVENTION

Field of the Invention

The present invention relates to a sheet conveying apparatus used for a printer, a digital multifunction imaging apparatus, or the like, and to an image forcing apparatus including the sheet conveying apparatus.

Description of the Related Art

Recently, there are many image forming apparatuses such as copying machines and laser printers, in which it is possible to form an image not only on toe first surface (front surface) of a sheet font also on the second surface (back surface) by using the electro-photographic system. In such an image forming apparatus, when images are formed on both sides of a sheet, after the printing on the first surface is performed by the image forming portion for forming an image, the sheet is temporarily retreated on a retreat conveying path. After the sheet is temporarily retreated on the retreat conveying path, switching of conveying paths is performed and the sheet is turned back so that the sheet is reversed. Then, the sheet is fed to the image forming portion again and printing on the second surface of the sheet is performed.

In the above image forming apparatus, a space is needed for the retreat conveying path whose length corresponds to that of the sheet retreated on the retreat path. Therefore, when a retreat conveying path is provided in an image forming apparatus, there is a problem that the image forming apparatus becomes larger as the sheet size becomes longer.

In order to deal with this problem, for example, in Japanese Laid-Open Patent Application Publication No. 2015-25911, a long sheet is bent a plurality of times at a substantially right angle to secure a retreat space even in a limited space and a retreat conveying path is provided in an option unit, thereby preventing the main body of the apparatus from becoming larger.

However, in the configuration in which a medium is bent a plurality of times at a substantially right angle on the retreat conveying path to secure a retreat space, a guide resistance applied to the leading end of the sheet conveyed at the bent portion increases. In this case, as the leading edge of the sheet is distanced away from the conveying roller provided in the retreat conveying path, the binding force against the sheet is lowered and buckling of the sheet tends to occur. In the case of a sheet with low stiffness, this tendency is more conspicuous. Particularly in the case where the sheet discharge direction by the conveying roller and the conveying direction of the leading end of the sheet after the sheet has been bent are opposite, the sheet may buckle at its leading end portion when the sheet leading end receives air resistance because the shape of the leading end of the sheet is restricted only by its own stiffness.

In addition, when a sheet with high rigidity is conveyed to the reversing portion, the guide resistance transiently increases every time the sheet passes through the bent portion, which may cause stepping-out of the conveying motor, slipping between the sheet and the roller, and skewing of the sheet.

SUMMARY OF THE INVENTION

A sheet conveying apparatus according to the present invention, comprising:

a conveying member configured to convey a sheet;

a first changing portion configured to change a conveying direction of the sheet conveyed by the conveying member by curving the sheet; and a second changing portion configured to change a conveying direction of the sheet conveyed by the conveying member by curving the sheet; and, wherein after the sheet is conveyed toward the first changing portion by the conveying member, the sheet is switched back and is conveyed by the conveying member, wherein the conveying direction of the sheet being conveyed by the conveying member is changed by the first changing portion so that the sheet is conveyed toward the second changing portion, and wherein the relationship $\theta a > \theta b$ is satisfied where $\theta a$ indicates an angle in which a conveying direction of the sheet is changed by the first changing portion and $\theta b$ indicates an angle in which a conveying direction of the sheet is changed by the second changing portion.

Further features of the present invention will become apparent from the following description of exemplary embodiments with reference to the attached drawings.

DESCRIPTION OF THE EMBODIMENTS

Next, a sheet conveying apparatus according to an embodiment of the present invention will be described with reference to the drawings, together with an image forming apparatus including the sheet conveying apparatus.

First Embodiment

<Overall Configuration of the Image Forming Apparatus>

Figure 1:
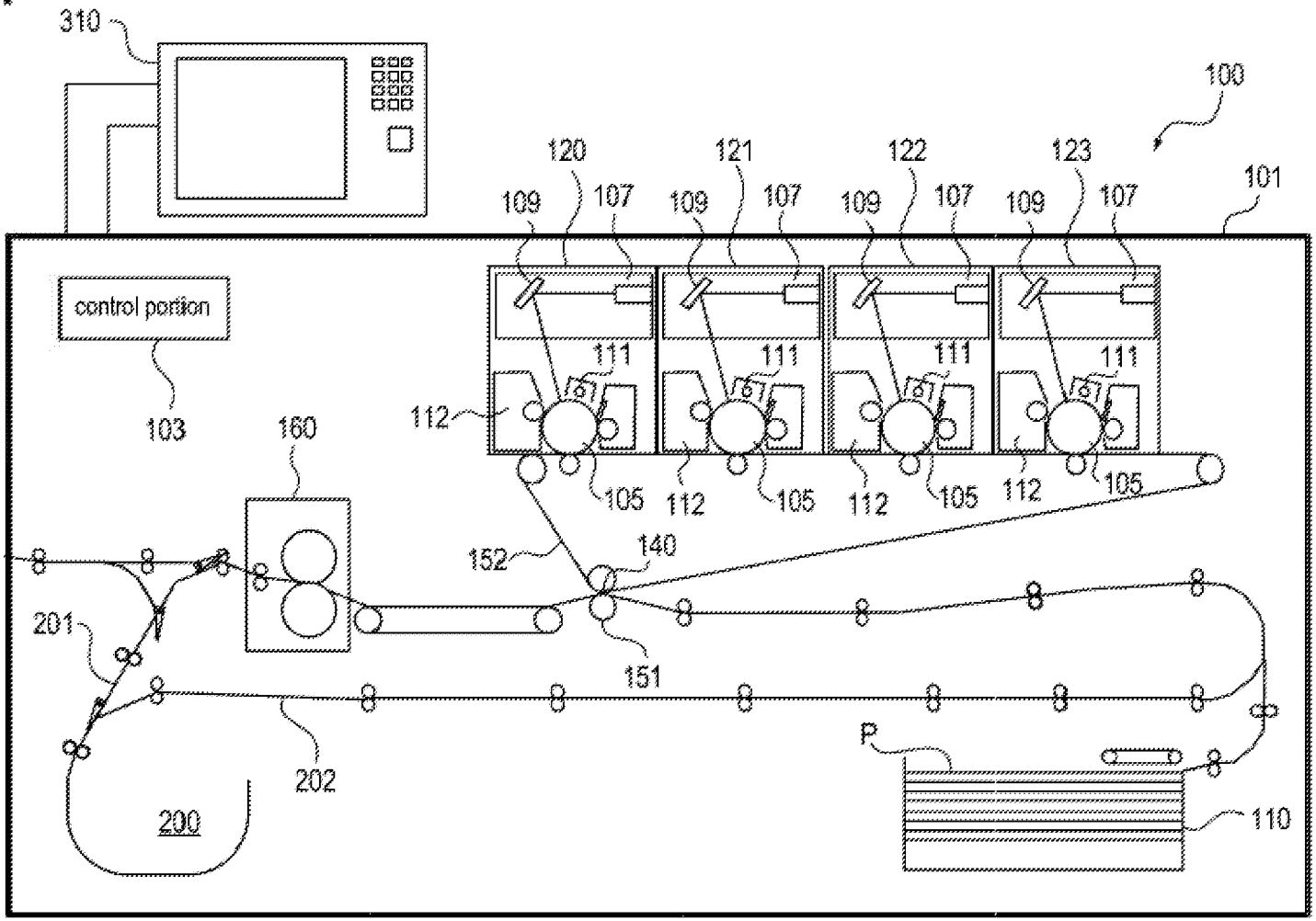
FIG. 1 is a diagram showing an overall view of an image forming apparatus.

First, the overall configuration of the image forming apparatus will be described, FIG. 1 is a cross-sectional view showing the configuration of the laser beam printer 100 (hereinafter referred to as a printer) according to this embodiment. As shown in this figure, the printer 100 has the housing 101 which includes the mechanisms for configuring the engine portion, an engine control portion for performing a control for printing processes (for example; a feeding process) by these mechanisms, and the control portion 103 which houses a printer controller.

These mechanisms for configuring the engine portion include an optical processing mechanism, a fixing processing mechanism, a feed processing mechanism for the sheet P and a conveying processing mechanism for the sheet P. The optical processing mechanism is used for forcing electrostatic latent images on the photosensitive drum 105 by scanning with a laser beam, for visualizing the electrostatic latent images, for multiply transferring the latent images onto the intermediate transfer body 152 configured by an endless belt, and for further transferring the multiply transferred color image onto the sheet P. The fixing processing mechanism is used for fixing a toner image transferred onto the sheet P.

The optical processing mechanism has a laser driver for turning on and off the laser light emitted from a semiconductor laser (not shown) in the laser scanner unit 107 in accordance with the image data supplied from the control portion 103. The laser beam emitted from the semiconductor laser is swung in the scanning direction by the rotating polygon mirror. The laser beam swung in the main scanning direction is introduced to the photosensitive drum 105 via the reflection polygon mirror 109, and exposes the photosensitive drum 105 in the main scanning direction.

On the other hand, the electrostatic latent image formed on the photosensitive drum 105 by being charged by the primary charger 111 and by being scanned by laser light is visualized into a toner image by the toner supplied, by the developing device 112. Then, the toner image visualized on the photosensitive drum 105 is transferred (primary transfer) onto the intermediate transfer body 152 to which a voltage having a polarity opposite to that of the toner image is applied. At the time of color image formation, the respective colors are sequentially formed on the intermediate transfer body 152 from the Y (yellow) station 120, the M (magenta) station 121, the C (cyan) station 122, and the K (black) station 123 so that a full color visible image is formed on the intermediate transfer body 152.

Next the sheet P fed from the sheet storage 110 is conveyed and the transfer roller 151 presses the sheet P against the intermediate transfer body 152 in the transfer portion 140. At the same time, a bias whose polarity is opposite to that of the toner is applied to the transfer roller 151. As a result, the visible image formed on the intermediate transfer body 152 is transferred (secondary transfer) onto the sheet P fed in the conveying direction (sub-scanning direction) in synchronization with the image formation.

After the secondary transfer, when the sheet passes through the fixing portion 160, the toner transferred onto the sheet P is heated and melted to be fixed on the sheet P as an image. In the case of duplex printing the sheet P on the first surface of which the image is formed is conveyed to the reversing portion 200, is switched back, and is introduced again to the transfer unit 140 where an image is formed on the second surface of the sheet P. Thereafter, when the sheet P passes through the fixing unit 160 in the same manner as described above, the toner image on the sheet P is thermally fixed. Then, the sheep P is discharged outside the printer and the printing process is completed.

Various sheets including a widely used plain paper, a recycled paper, a glossy paper, a coated paper, a thin paper, and a thick paper are used in the printer.

<Sheet Conveying Apparatus>

Next, the configuration of the reversing portion 200 which is the sheet conveying apparatus of this embodiment will be described.

Figure 2:
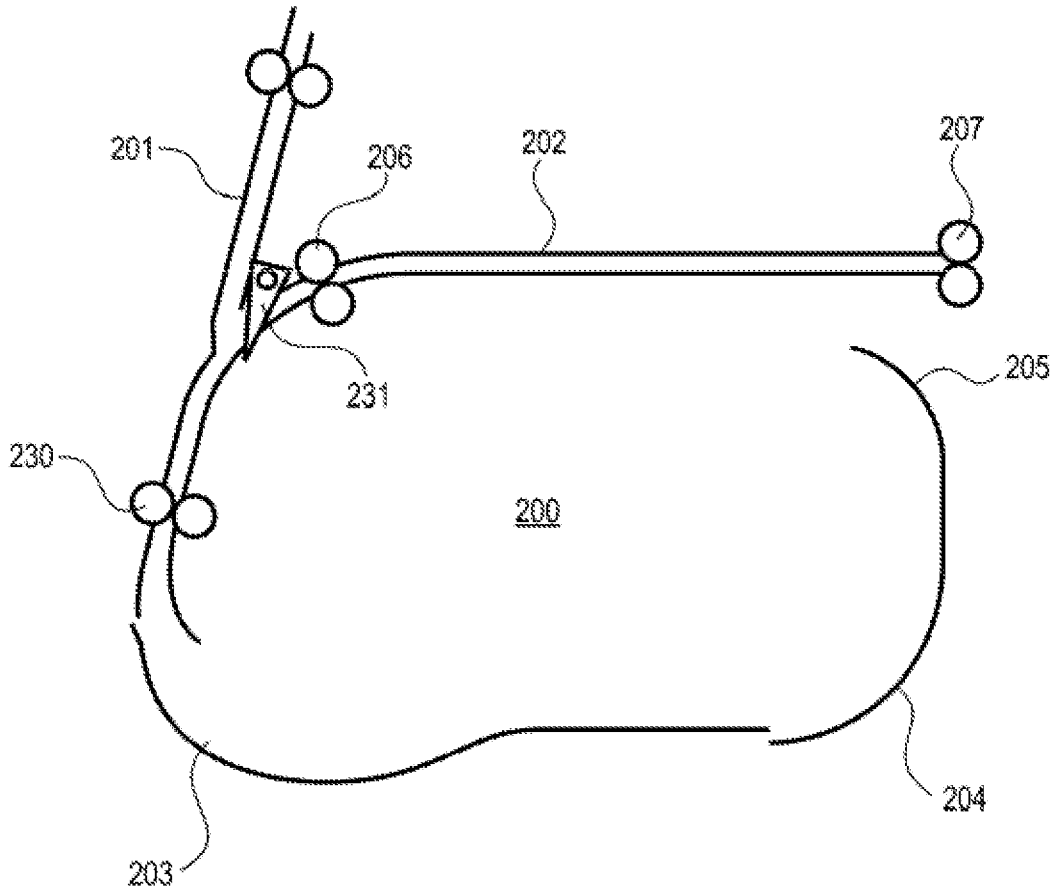
FIG. 2 is a diagram showing a periphery of a reversing portion as viewed from the front of the main body.

FIG. 2 is a diagram showing a schematic view of the periphery of the reversing portion 200 as viewed from the front of the main body. The upstream conveying path 201 is provided upstream of the reversing section 200 in the sheet conveying direction (hereinafter, simply "upstream"). The downstream conveying path 202 is provided downstream of the reversing portion 200 in the sheet conveying direction (hereinafter simply "downstream"). The sheet P is conveyed from the upstream conveying path 201 to the reversing portion 200 and is temporarily stopped at the reversing portion 200. Thereafter, the sheet P is switched back and is conveyed to the downstream conveying path 202.

Figure 3:
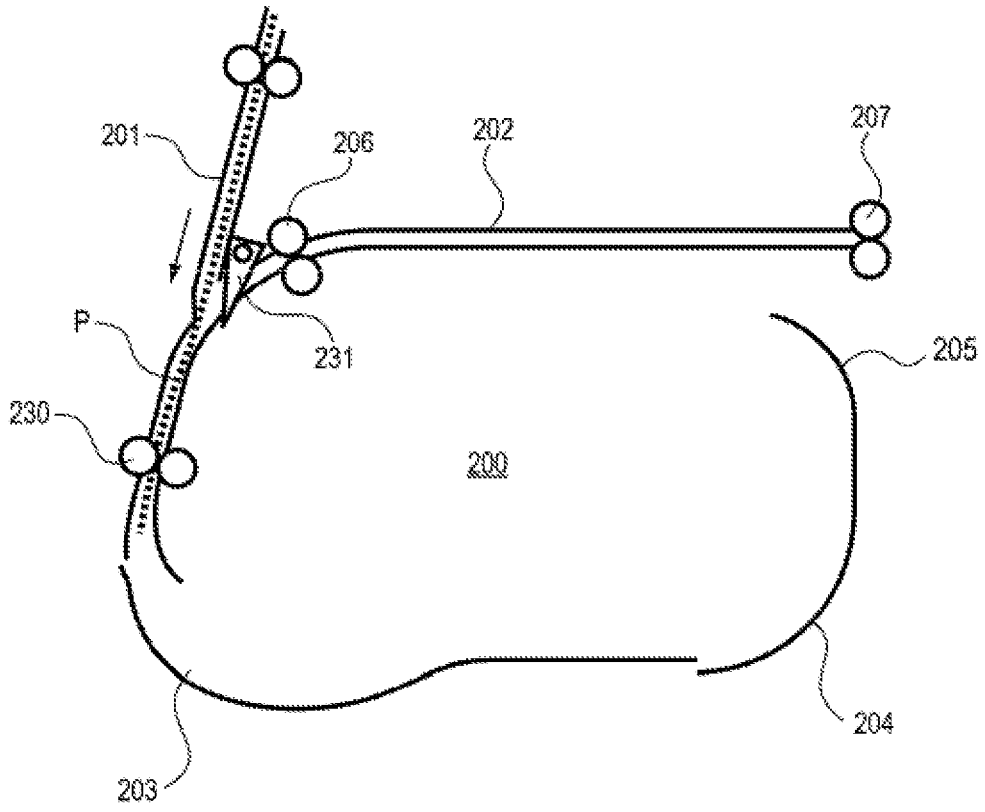
FIG. 3 is a schematic diagram showing a movement of the sheet P at a reversing portion.
Figure 4:
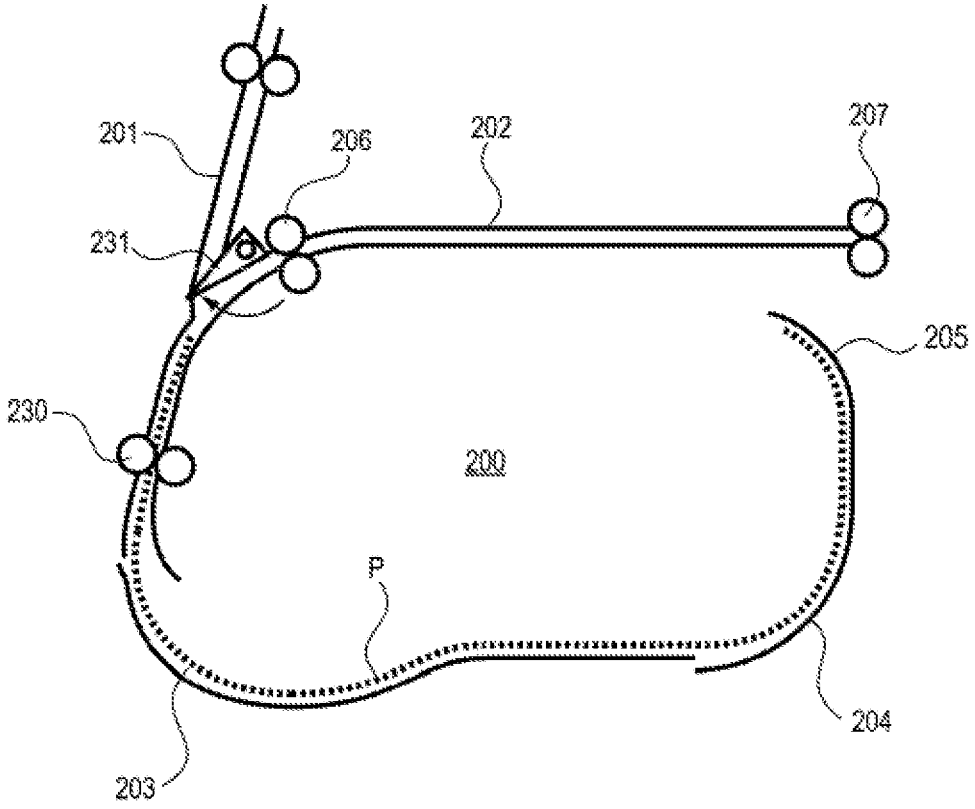
FIG. 4 is a schematic diagram showing a movement of the sheet P at the reversing portion.
Figure 5:
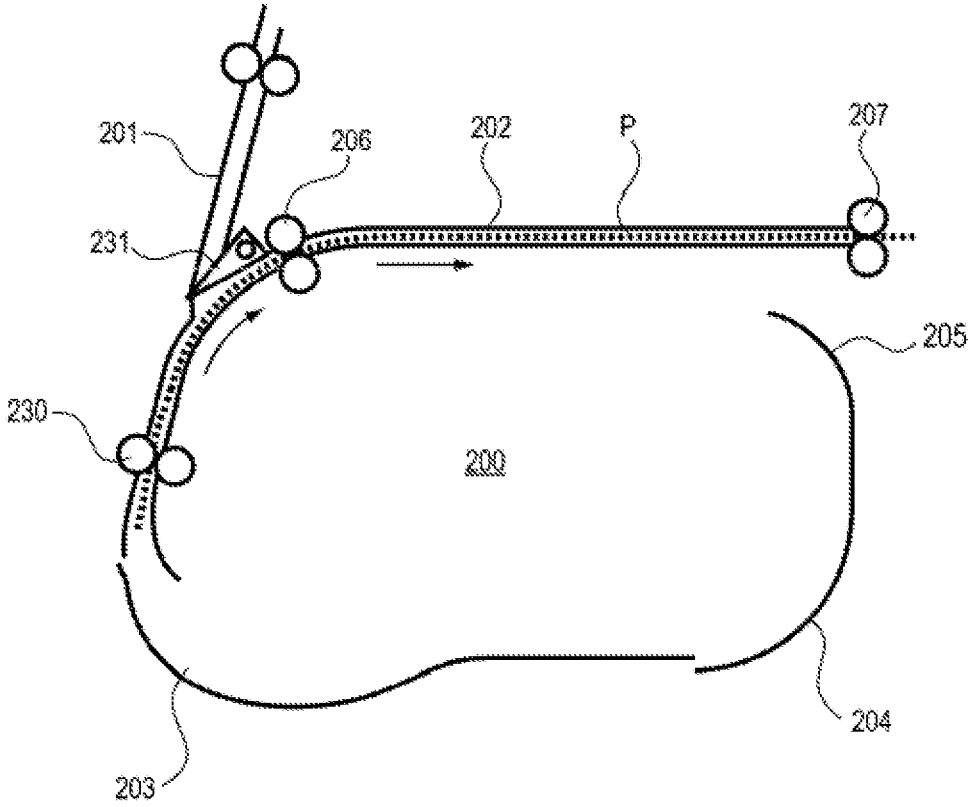
FIG. 5 is a schematic diagram showing a movement of the sheet P at the reversing portion.

For switching the conveying paths, the path switching member 231 which is rotatable is used. The reversing roller 230 serving as a conveying member is provided at a position where the upstream conveying path 201 and the downstream conveying path 202 join upstream of the reversing portion 200. The reversing roller 230 is a conveying roller capable of rotating forwardly and reversely. The reversing roller 230 rotates in one direction when conveying the nipped sheet P from the upstream conveying path 201 to the reversing portion 200, and rotates in the reverse direction (the other direction) when conveying the nipped sheet P from the reversing portion 200 to the downstream conveying path 202. Accordingly, after the sheet P is conveyed from the upstream conveying path 201 to the reversing portion 200 as shown in FIG. 3, the conveying direction is changed to the opposite direction and the sheet P is conveyed from the reverse portion 200 to the downstream conveying path 202 as shown in FIG. 4. As a result, when the sheet on which an image is recorded on the first surface is reversed and the sheet is conveyed to the transfer portion 140 again by the conveying rollers 206 and 207 provided at the downstream conveying path 202, an image is recorded on the second surface.

(Curved Portion)

Figure 6:
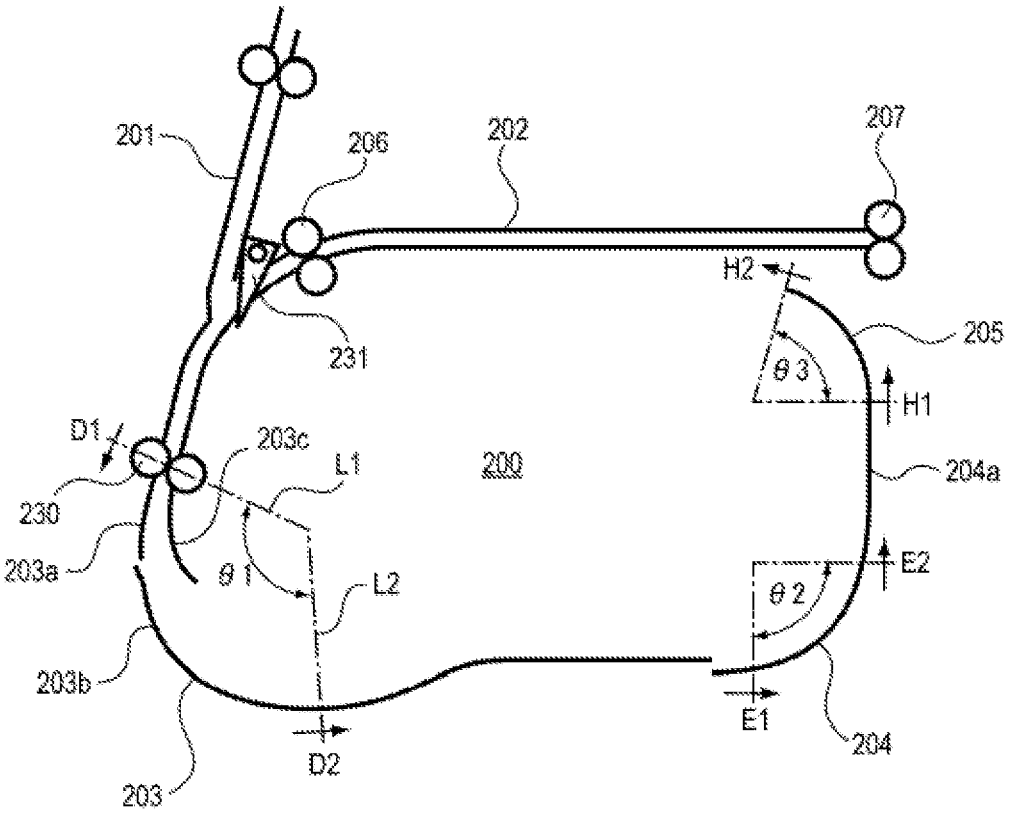
FIG. 6 is a schematic diagram showing configurations of the conveying guides at curved portions of the reversing portion.

The reversing portion 200 is provided with a plurality of curved portions which serve as changing portions for changing the conveying direction by curving the sheet conveyed downstream of the reversing roller 230. In the present embodiment, as shown in FIG. 6, three curved portions of the first curved portion 203, the second curved portion 204, and the third curved portion 205 are provided in this order from a position close to the reversing roller 230. By thus providing a plurality of curved portions, the sheet conveyed to the reversing portion 200 is curved in a substantially C shape. Therefore, even if the sheet size is increased, it is possible to perform switchback conveyance without increasing the size of the apparatus.

Next, each curved portion will be specifically explained. At each curved portion, a guide member for guiding the sheet P is curved. As a result, the sheet P is conveyed while the conveying direction of the sheet P is changed when the sheet P is curved by the guidance of the guide member.

As shown in FIG. 6, the first curved portion 203 has the conveying guide member 203*a* and the curved conveying guide members 203*b* and 203*c*. The first curved portion 203 is provided on the extension of the direction in which the sheet P is discharged from the reversing roller 230 to the reversing portion 200. In the present embodiment, the sheet P conveyed downward in the substantially vertical direction (in the direction of the arrow D1 in FIG. 6) from the reversing roller 230 is conveyed along the first curved portion 203. As a result, the conveying direction of the sheet P is changed to the substantially horizontal direction (the arrow D2 in FIG. 6).

The second curved portion 204 is provided downstream of the sheet which has passed through the first curved portion 203. The second bending portion 204 is constituted by the conveying guide member 204*a* which is formed in a curved shape. The sheet conveyed in a substantially horizontal direction (the direction of the arrow E1 in FIG. 6) is conveyed along the second curved portion 204 so that the conveying direction is changed in the vertically upward direction (the direction of the arrow E2 in FIG. 6).

Further, the third curved portion 205 is provided downstream of the sheet which has passed through the second curved portion 204. The third curved portion 205 is formed by curving a guide member integrated with the conveying guide member 204*a* which constitutes the second curved portion 204. The sheet conveyed in a direction substantially vertically upward (direction of arrow H1 in FIG. 6) is conveyed along the third curved portion 205 so that the conveying direction is changed in an obliquely upward direction (direction of arrow H2 in FIG. 6).

(Change in Angle of Sheet Conveying Direction)

As described above, when the sheet sent to the reversing portion 200 is conveyed by the reversing roller 230, the conveying direction of the sheet is changed by the curved portions so that the sheet is conveyed in a substantially C shape. In the present embodiment, the curved portions are configured such that the angle θ1 of the sheet conveying direction changed by the first curved portion 203, the angle 62 of the sheet conveying direction changed by the second curved portion 204 and the angle θ3 of the sheet conveying direction changed by the third curved portion 205 have the relationship of θ1>θ2>θ3.

The angle of the sheet conveying direction changed by each curved, portion is defined as follows. At the first curved portion, for example, the angle of the sheet conveying direction changed is defined as the angle formed between the perpendicular line L1 to the entering direction (direction of the arrow D1 in FIG. 6) in which the sheet enters the first curved portion 203 and the perpendicular line L2 to the discharging direction (direction of the arrow D2 in FIG. 6) in which the sheet is discharged from: the first curved portion 203.

In the present embodiment, the changed angle θ1 is set to about 125°, the changed angle θ2 is set to about 90°, and the changed angle θ3 is set to about 55°.

The plurality of curved portions 203, 204, and 205 are provided in the reversing portion 200 such that the changed angle is made greater at a curved portion closer to the reversing roller 230 and is made less at a curved portion, farther from reversing roller 230 as described above, thereby suppressing buckling of the sheet. This reason will be explained below.

Figure 7:
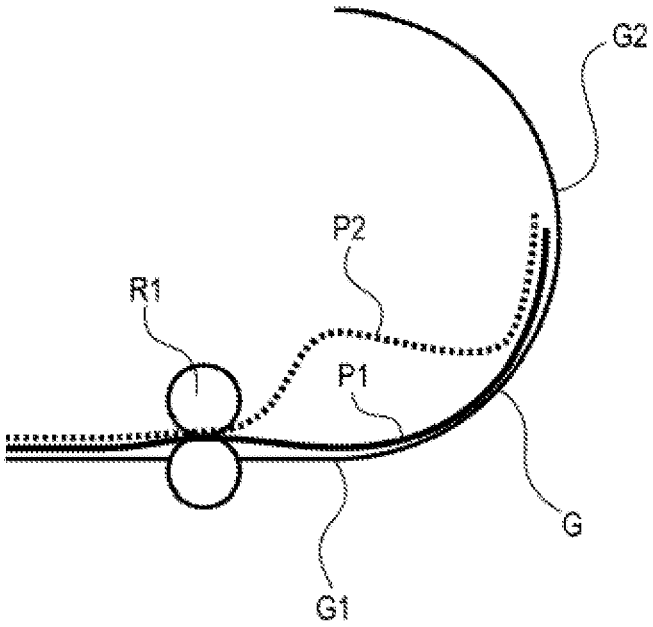
FIG. 7 is a schematic diagram showing a mechanism of buckling in the case where a conveying roller is provided close to a curved portion.
Figure 8:
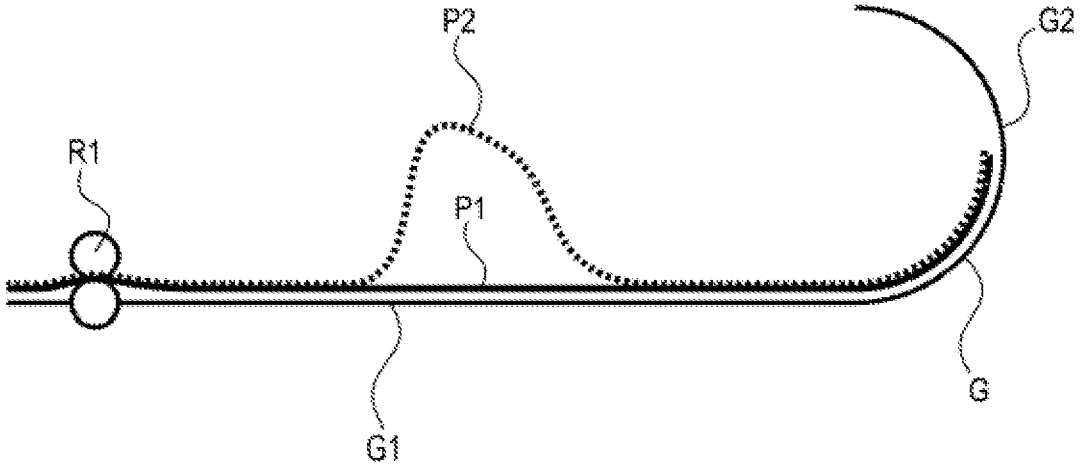
FIG. 8 is a schematic diagram showing a mechanism of buckling in the case where the conveying roller is provided far from a curved portion.

FIG. 7 is a schematic view of a state in which a sheet buckles at the curved portion G close to the pair of conveying rollers R1. FIG. 8 is a schematic diagram showing a view of a state in which a sheet buckles at the curved portion G far from the pair of conveying rollers R1. In FIGS. 7 and 8, the solid line P1 schematically indicates a sheet which does not buckle and broken line P2 schematically indicates a sheet which buckles on a simple conveying path having the pair of conveying rollers R1, the curved portion G constituted of the straight guide G1 and the curved guide G2.

When changing the conveying direction of the leading edge of the sheet using the curved, portion G, as the changed angle at the curved portion G increases, the guide resistance received by the sheet increases. On the other hand, as shown in FIG. 1, when the leading end of the sheet is close to the pair of conveying rollers R1 which nips and conveys the sheet, the shape of the sheet can be held by the shape holding force which is produced by the nipping force of the pair of conveying rollers E1 and the stiffness of the sheet itself.

However, as shown in FIG. 8, when the leading edge of the sheet is far from the pair of conveying rollers R1, the degree of freedom of the entire sheet increases as compared with the case shown in FIG. 7, thereby reducing the influence of the nipping force of the pair of conveying rollers R1. Therefore, the shape holding force for holding the shape of the sheet mainly depends on the stiffness of the sheet itself. Therefore, in the case where the stiffness of the sheet is low such as a thin sheet, when the shape holding force of the sheet falls below the guide resistance at the curved portion G, the conveying rollers R1 continue to convey the sheet although the leading end of the sheet cannot advance further. As a result, the buckling occurs between the conveying rollers R1 and the leading edge of the sheet as indicated by the broken line P2. In particular, when the conveying direction of the sheet which has been fed by the conveying rollers R1 is changed and the sheet is conveyed in the direction substantially opposite to the direction in which the sheet is discharged from the conveying roller R1, buckling of the sheet is likely to occur because the guide resistance increases.

Therefore, in the present embodiment, the angles of the sheet changed at the curved portions are set as follows. Namely, the angle θa of the sheet changed at a curved portion (upstream changing portion) which is closer to the reversing roller 230 and at which the shape holding force of the sheet is easy to maintain and the angle θb of the sheet changed at a curved portion (downstream changing portion) which is farther from the reversing roller 230 and at which the shape holding force of the sheet is decreased are set to have the relation θa>θb, thereby to suppress an increase in guide resistance at a position where the leading end of a sheet is far from the reversing roller 230 so that the guide resistance does not exceed the shape holding force of the sheet.

An angle of the sheet conveying direction is changed in a smaller amount at a curved portion which is farther from the reversing roller 230 in the present embodiment. However, it is sufficient that the relationship θa>θb is met between the changed, angle at the first curved portion 203 (upstream changing portion) and the changed angle at the second curved, portion 204 (downstream changing portion) or between the changed angle at the second curved portion 204 (upstream changing portion) and the changed angle at the third curved portion 205 (downstream changing portion). Namely, it is not intended to limit the case where the relationship θa>θb is met among the changed angles of all three curved portions. In other words, it is sufficient that the relationship of θ1>θ2 or θ2>θ3 is met and the invention is not necessarily limited to the relationship θ1>θ2>θ3.

(Remaining Sheet Discharge Portion)

In addition to the function of the retreat conveying path for switching back the sheets, the reversing portion 200 of the image forcing apparatus of the present embodiment also has the function of a remaining sheet discharging portion which collects sheets remaining in the apparatus and discharges the collected remaining sheets when the sheet jams in the image forming apparatus main body.

Figure 9:
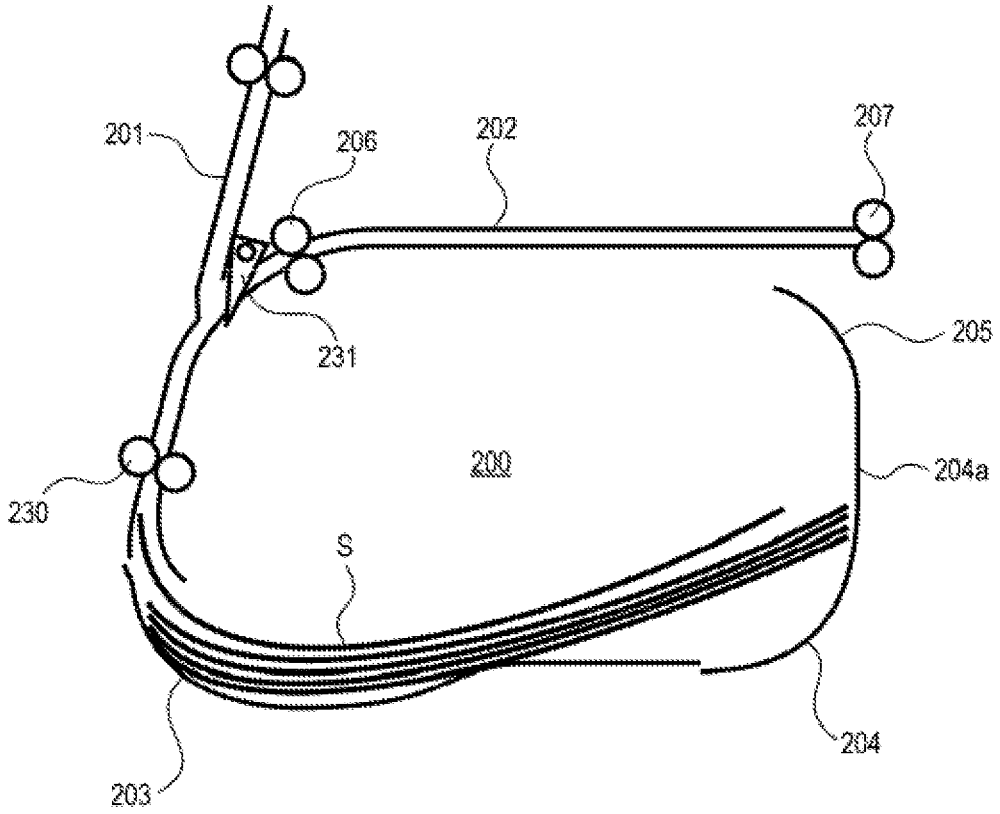
FIG. 9 is a schematic diagram showing stacking of remaining sheets in the reversing portion.

FIG. 9 is a schematic diagram of reversing portion 200 showing the case where the remaining sheets S are discharged to the reversion portion 200 of the present embodiment. The sheet S is a discharged remaining sheet. With the configuration of this embodiment, it is possible to suppress buckling while the sheet is conveyed. As a result, only one side of the conveying guide is required and it is not necessary to provide the conveying guides for both sides of the sheet in order to suppress the buckling of the sheet. Therefore, a conveying path can be formed by a guide member which guides one surface of the sheet. As shown in FIG. 9, by providing a guide member only on the lower surface side of the sheet of at least a part of the conveying path of the reversing portion and by exposing the upper surface side, it is possible to secure a large space for stacking discharged sheets. Further, it is not necessary to provide a mechanize such as opening and closing the conveying guide. Therefore, it is possible to simplify the removal of the discharged sheets.

Second Embodiment

In the above-described embodiment, the directions in which angles of sheet conveying direction are chanced at three curved portions are all counterclockwise. However, it is not necessary that all the directions in which angles of the sheet conveying direction are changed at the plurality of curved portions are the same.

Figure 10:
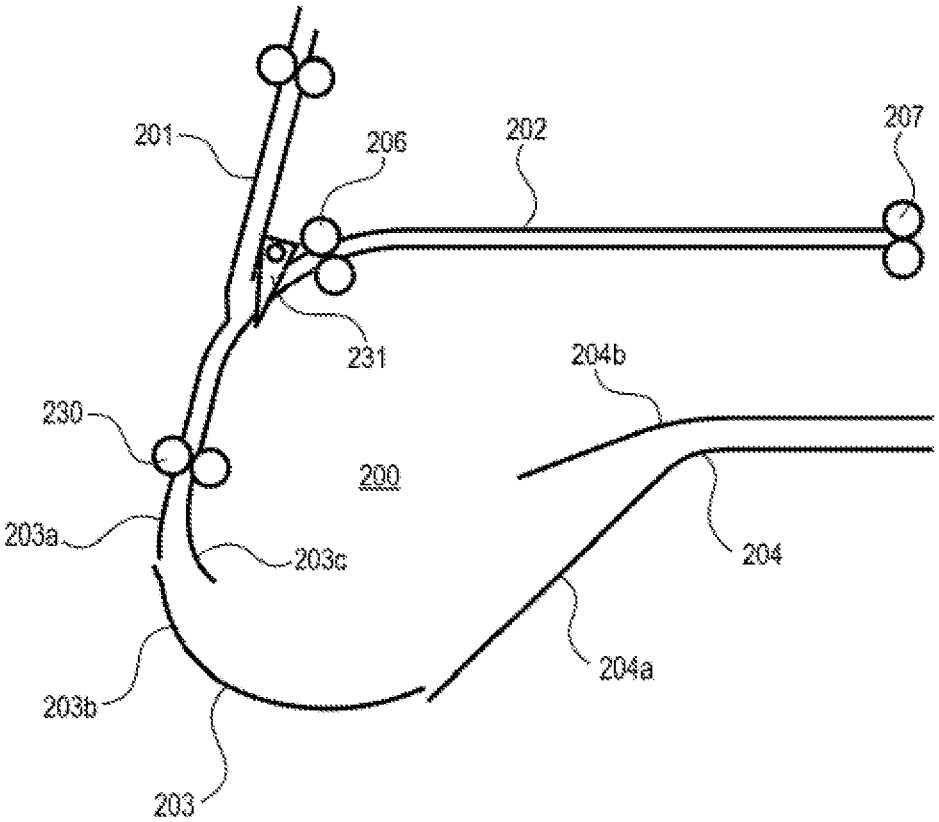
FIG. 10 is a schematic diagram showing configurations of conveying guides in the reversing portion according to the second embodiment of the present invention.

For example, as shown in FIG. 10, the conveying direction of the sheet is changed counterclockwise in the first curved portion 203, but at the second curved portion 204, the guiding members 204*a* and 204*b* guide the sheet on both sides respectively and the conveying direction of the sheet is changed clockwise, Even with such a configuration, when the relationship $\theta a > \theta b$ is met where $\theta a$ denotes an angle of a sheet which is changed at the first curved portion 203 (upstream changing portion) and $\theta b$ denotes an angle of a sheet which is changed at the second carved portion 204 (downstream changing portion), the similar effect of the above-described embodiment can be achieved.

Third Embodiment

Figure 11:
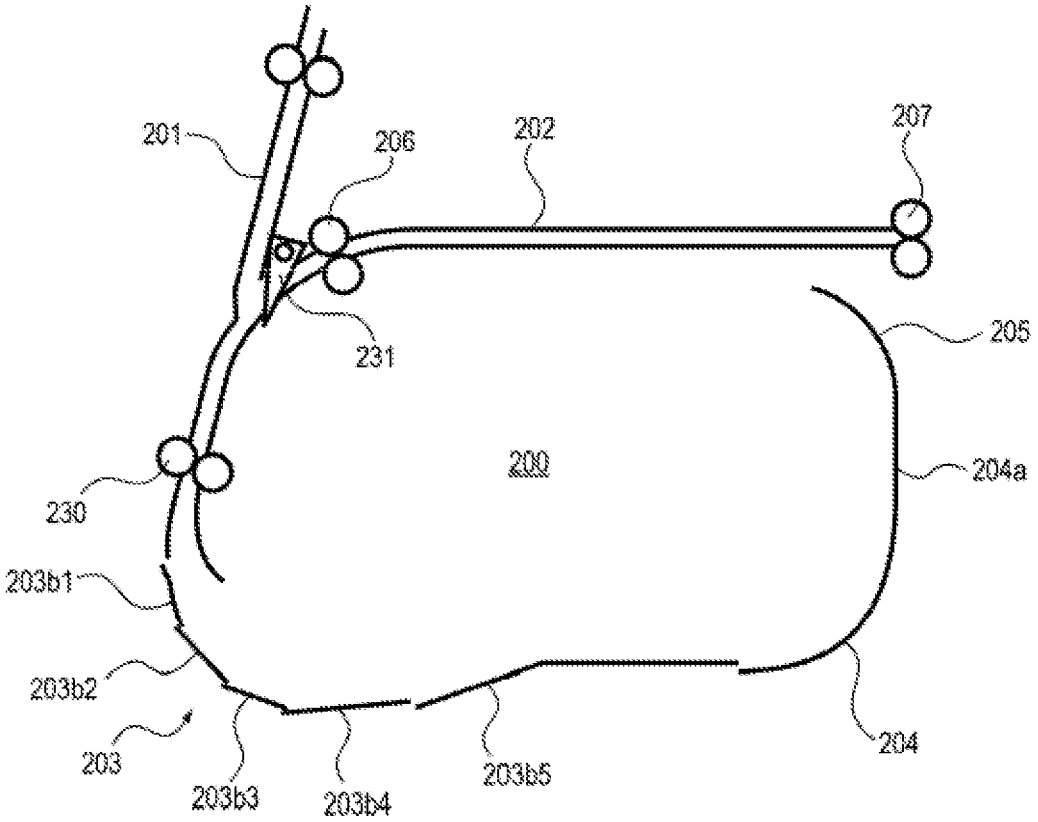
FIG. 11 is a schematic diagram showing configurations of conveying guides in the reversing portion according to the third embodiment of the present invention.

In the above-described embodiment, an example is shown in which the first curved portion 203 is constituted by three guide members 203*a*, 203*b* and 203*c*, However, as shown in FIG. 11, instead of providing the curved guide member 203*b*, it is possible to configure a curved portion by forming a curved sheet conveying path by a plurality of linear guide members 203*b*1, 203*b*2, 203*b*3, 203*b*4 and 203*b*5.

As described above, by configuring a curved portion by combining linear guide members or arc-shaped guide members, the setting of the angle in which the conveying direction of the sheet is changed becomes easier as compared with the case where a single guide member is curved in accordance with the angle in which the sheet conveying direction is changed.

While the present invention has been described with reference to exemplary embodiments it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-085130, filed Apr. 24, 2017, which is hereby incorporated by reference herein in its entirety.

What is claimed is:

1. A sheet conveying apparatus comprising:

a conveying roller configured to convey a sheet by rotating in a second rotating direction, which is opposite to a first rotating direction, after the conveying roller conveys a sheet by rotating in the first rotating direction, and to convey a sheet downward by rotating in the first rotating direction; and a first changing portion disposed below the conveying roller, and configured to change a conveying direction of a leading edge of the sheet conveyed by the conveying roller by curving the sheet;

a second changing portion disposed at a position different from the first changing portion in a horizontal direction, and configured to change the conveying direction of the leading edge of the sheet conveyed by the conveying roller by curving the sheet; and a third changing portion disposed at a position above the second changing portion, and configured to change the conveying direction of the leading edge of the sheet conveyed by the conveying roller by curving the sheet, wherein the sheet conveyed by the conveying roller rotating in the first rotating direction is conveyed toward to the first changing portion, wherein after the conveying direction of the leading edge of the sheet being conveyed by the conveying roller rotating in the first rotating direction is changed by the first changing portion, the sheet being conveyed by the conveying roller rotating in the first rotating direction is conveyed toward the second changing portion, wherein after the conveying direction of the leading edge of the sheet being conveyed by the conveying roller rotating in the first rotating direction is changed by the second changing portion, the sheet being conveyed by the conveying roller rotating in the first rotating direction is conveyed toward the third changing portion, wherein after the conveying direction of the leading edge of the sheet conveyed by the conveying roller rotating in the first rotating direction is changed by the third changing portion, a rotating direction of the conveying roller changes from the first rotating direction to the second rotating direction to convey the sheet, and wherein the relationship $\theta 1 > \theta 2 > \theta 3$ is satisfied, where $\theta 1$ indicates an angle in which a conveying direction of the sheet is changed by the first changing portion, $\theta 2$ indicates an angle in which a conveying direction of the sheet is changed by the second changing portion, and $\theta 3$ indicates an angle in which a conveying direction of the sheet is changed by the third changing portion.

2. The sheet conveying apparatus according to claim 1, wherein the second changing portion is configured to change the conveying direction of the sheet upward.

3. The sheet conveying apparatus according to claim 1, wherein the second changing portion comprises a guide member having a curving shape to contact with one surface of the sheet and no guide member for guiding the other surface of the sheet.

4. The sheet conveying apparatus according to claim 1, wherein the first and second changing portions include a guide member for guiding the sheet.

5. The sheet conveying apparatus according to claim 1, wherein at least one of the first and second changing portions includes a plurality of guide members for guiding the sheet.

6. The sheet conveying apparatus according to claim 1, wherein at least a part of a sheet conveying path from the conveying roller to the first and second changing portions includes a guide member for guiding one surface of a conveyed sheet.

7. The sheet conveying apparatus according to claim 1, wherein the conveying roller conveys the leading edge of the sheet toward the first changing portion by rotating in the first rotating direction, and wherein the conveying direction of the sheet is changed so that the leading edge of the sheet is conveyed toward the second changing portion by the conveying roller rotating in the first rotating direction.

8. The sheet conveying apparatus according to claim 1, wherein the first changing portion comprises a first guide which is curved, and the second changing portion comprises a second guide which is curved, and wherein the sheet conveying apparatus further comprises a straight conveying guide disposed between the first guide and the second guide.

9. The sheet conveying apparatus according to claim 1, wherein θ1 is larger than 90°.

10. The sheet conveying apparatus according to claim 1, wherein a member to nip the sheet to be conveyed is not disposed between a conveying route in which the sheet passes from the conveying roller to the second changing portion.

11. The sheet conveying apparatus according to claim 1, wherein the conveying roller conveys the leading edge of the sheet toward the first changing portion by rotating in the first rotating direction, wherein the conveying direction of the sheet conveyed by the conveying roller rotating in the first rotating direction is changed so that the leading edge of the sheet is conveyed toward the second changing portion by the first changing portion, and wherein the conveying direction of the sheet conveyed by the conveying roller rotating in the first rotating direction is changed so that the leading edge of the sheet is conveyed toward the third changing portion by the second changing portion.

12. The sheet conveying apparatus according to claim 1, wherein the first changing portion comprises a first guide which is curved, and the second changing portion comprises a second guide which is curved, and the third changing portion comprises a third guide which is curved, and wherein the sheet conveying apparatus further comprises (i) a first straight conveying guide disposed between the first guide and the second guide and (ii) a second straight conveying guide disposed between the second guide and the third guide.

13. The sheet conveying apparatus according to claim 1, wherein θ1 is larger than 90°, and θ3 is smaller than 90°.

14. The sheet conveying apparatus according to claim 1, wherein a member to nip the sheet to be conveyed is not disposed between a conveying route in which the sheet passes from the conveying roller to the third changing portion.

15. The sheet conveying apparatus according to claim 1, wherein the first changing portion comprises a first guide which is curved, wherein the second changing portion comprises a second guide which is curved, and wherein the sheet conveying apparatus further comprises a first straight conveying guide disposed between the first guide and the second guide in a horizontal direction.

16. The sheet conveying apparatus according to claim 1, wherein the first changing portion and the second changing portion are disposed at an overlapped position as viewed in a horizontal direction.

17. The sheet conveying apparatus according to claim 1, wherein a sheet conveying direction is changed by the first changing portion from a nipping line direction to a first direction which is horizontal and the angle θ1 is an angle formed with a perpendicular line for a nipping line of the conveying roller and a perpendicular line to the first direction, and wherein the sheet conveying direction is changed by the second changing portion from the first direction to a second direction which is vertical and the angle θ2 is an angle formed with a perpendicular line to the first direction and a perpendicular line to the second direction.

18. An image forming apparatus comprising:

an image forming portion configured to form an image on a sheet;

a conveying roller configured to convey a sheet by rotating in a second rotating direction, which is opposite to a first rotating direction, after the conveying roller conveys a sheet by rotating in the first rotating direction, and to convey a sheet downward by rotating in the first rotating direction;

a first changing portion disposed below the conveying roller, and configured to change a conveying direction of a leading edge of the sheet conveyed by the conveying roller by curving the sheet;

a second changing portion disposed at a position different from the first changing portion in a horizontal direction, and configured to change the conveying direction of the leading edge of the sheet conveyed by the conveying roller by curving the sheet; and a third changing portion disposed at a position above the second changing portion, and configured to change the conveying direction of the leading edge of the sheet conveyed by the conveying roller by curving the sheet, wherein the sheet conveyed by the conveying roller rotating in the first rotating direction is conveyed toward the first changing portion, wherein after the conveying direction of the leading edge of the sheet being conveyed by the conveying roller rotating in the first rotating direction is changed by the first changing portion, the sheet being conveyed by the conveying roller rotating in the first rotating direction is conveyed toward the second changing portion, wherein after the conveying direction of the leading edge of the sheet being conveyed by the conveying roller rotating in the first rotating direction is changed by the second changing portion, the sheet being conveyed by the conveying roller rotating in the first rotating direction is conveyed toward the third changing portion, wherein after the conveying direction of the leading edge of the sheet conveyed by the conveying roller rotating in the first rotating direction is changed by the third changing portion, a rotating direction of the conveying roller changes from the first rotating direction to the second rotating direction to convey the sheet, and wherein the relationship $\theta 1 > \theta 2 > \theta 3$ is satisfied where θ1 indicates an angle in which a conveying direction of the sheet is changed by the first changing portion, θ2 indicates an angle in which a conveying direction of the sheet is changed by the second changing portion, and θ3 indicates an angle in which a conveying direction of the sheet is changed by the third changing portion.

* * * * *